United States Patent [19]

Dahl

[11] 4,452,214

[45] Jun. 5, 1984

[54] FUEL MIXING DEVICE

[75] Inventor: Byron M. Dahl, Watertown, S. Dak.

[73] Assignee: Fuel Efficiency Co., S. Dak.

[21] Appl. No.: 301,955

[22] Filed: Sep. 14, 1981

[51] Int. Cl.[3] ..... F02M 17/26

[52] U.S. Cl. ..... 123/523; 123/524; 123/590; 48/180 R; 48/189

[58] Field of Search ..... 123/523, 524, 590, 1 A; 48/180 R, 180 A, 180 C, 180 M

[56] References Cited

U.S. PATENT DOCUMENTS

| | | | |
|---|---|---|---|
| 712,542 | 11/1902 | Jeffery | 123/524 |
| 1,261,230 | 4/1918 | Haynes et al. | 123/523 |
| 1,882,318 | 11/1932 | Curioni | 123/523 |
| 1,885,697 | 11/1932 | Fabbro | 123/592 |
| 4,111,160 | 9/1978 | Talenti | 123/DIG. 12 |

*Primary Examiner*—Ira S. Lazarus
*Assistant Examiner*—E. Rollins Cross
*Attorney, Agent, or Firm*—Dorsey & Whitney

[57] ABSTRACT

A fuel mixing device is provided an more particularly on improved fuel mixing device for an internal combustion engine which improves the fuel efficiency of the engine to obtain a more complete utilization of the power transmitting properties of the fuel.

16 Claims, 4 Drawing Figures

FUEL MIXING DEVICE

BACKGROUND OF THE INVENTION

The present invention relates generally to a fuel mixing device, and more particularly to an improved fuel mixing device for an internal combustion engine which improves the fuel efficiency of the engine to obtain a more complete utilization of the power transmitting properties of the fuel.

A great number of fuel mixing devices or carburetors for internal combustion engines exist in the prior art. Many of these have been designed to increase the fuel effieiency of an internal combustion engine usable in an automobile. Such design efforts have been increased in recent years due primarily to the shortage of gasoline and other petroleum based fuels. Although these attempts have resulted in fuel mixing devices with some increase in fuel efficiency, none of these devices has led to a carburetor design in which, under certain conditions, the fuel efficiency can be increased as much as two or three fold.

Accordingly, there is a need in the art for an improved fuel mixing device or carburetor for an internal combustion engine capable of dramatically improving the fuel efficiency of such engine.

SUMMARY OF THE INVENTION

The present invention relates to an improved fuel mixing device for an internal combustion engine which includes a means for improving the atomization and vaporization, and thus the efficiency of the fuel. Part of the increase in fuel efficiency results from an improved atomization device and part from the utilization of warm air from the manifold of the engine for use as atomizing or vaporizing air. The device of the present invention also includes means for supplementing the air/fuel mixture provided to the power cylinders with a small supply of hydrogen. It has been found that this supply of hydrogen, both by itself, but also particularly in combination with the improved atomization means results in dramatic improvement in the fuel efficiency of an internal combustion engine.

More specifically, the structure of the present invention includes a stationary fuel atomization chamber and a rotatable atomization drum disposed within this chamber. The atomization drum is adapted for rotation about its longitudinal or axial axis. The drum includes a hollow interior and a side wall comprised of a porous, screen-like or filter-like material. Valve means are provided for maintaining a level of fuel within the fuel atomization chamber sufficient to cover or contact at least a portion of the porous side wall of the rotatable atomization drum. As the drum is rotated, the liquid fuel becomes entrained in the porous side wall and is exposed to incoming, atomization air as the drum rotates out of the fuel supply. Means is also included in the device of the present invention for providing a supply of atomizing air to the interior of the rotatable atomizing drum. In one embodiment of the present invention, this means includes a means for directing warm air from the engine manifold to the interior of the atomizing drum as atomizing air. This warm air improves the atomization and vaporization of the fuel and thus improves the efficiency of the engine.

The device of the present invention also includes a means for supplementing the air/fuel mixture with a small supply of hydrogen. In the preferred embodiment, the hydrogen is supplied downstream from the atomization chamber, but upstream of the butterfly valve or other throttling device for metering the air/fuel mixture into the combustion chambers. In the preferred embodiment, the source of hydrogen is provided by a plurality of plates immersed in a soda water bath and connected with the leads of a five volt regulator.

It has been found that the above invention dramatically improves the fuel efficiency of an internal combustion engine and under certain conditions has improved such efficiency as much as two or three fold. Additionally, it is believed that emissions from an engine utilizing the device of the present invention will pass pollution control specifications, thus eliminating the need for a catalytic converter.

Accordingly, an object of the present invention is to provide an improved fuel mixing device for an internal combustion engine.

Another object of the present invention is to provide a fuel mixing device for an internal combustion engine having improved fuel atomization means.

A further object of the present invention is to provide a fuel mixing device for an internal combustion engine in which the atomization means includes a rotatable drum having a porous screen-like or filter-like side wall.

Another object of the present invention is to provide a fuel mixing device for an internal combustion engine having means for supplementing the air/fuel mixture with a small amount of hydrogen.

A still further object of the present invention is to provide a fuel mixing device for an internal combustion engine comprising an improved atomization means in combination with a means for supplementing the air/fuel mixture with hydrogen.

Another object of the present invention is to provide a fuel mixing device for an internal combustion engine including means for utilizing warm air from the manifold to improve atomization of the fuel.

These and other objects of the present invention will become apparent with reference to the drawings, the description of the preferred embodiment and the appended claims.

DESCRIPTION OF THE PREFERRED EMBODIMENT

Figure 1:
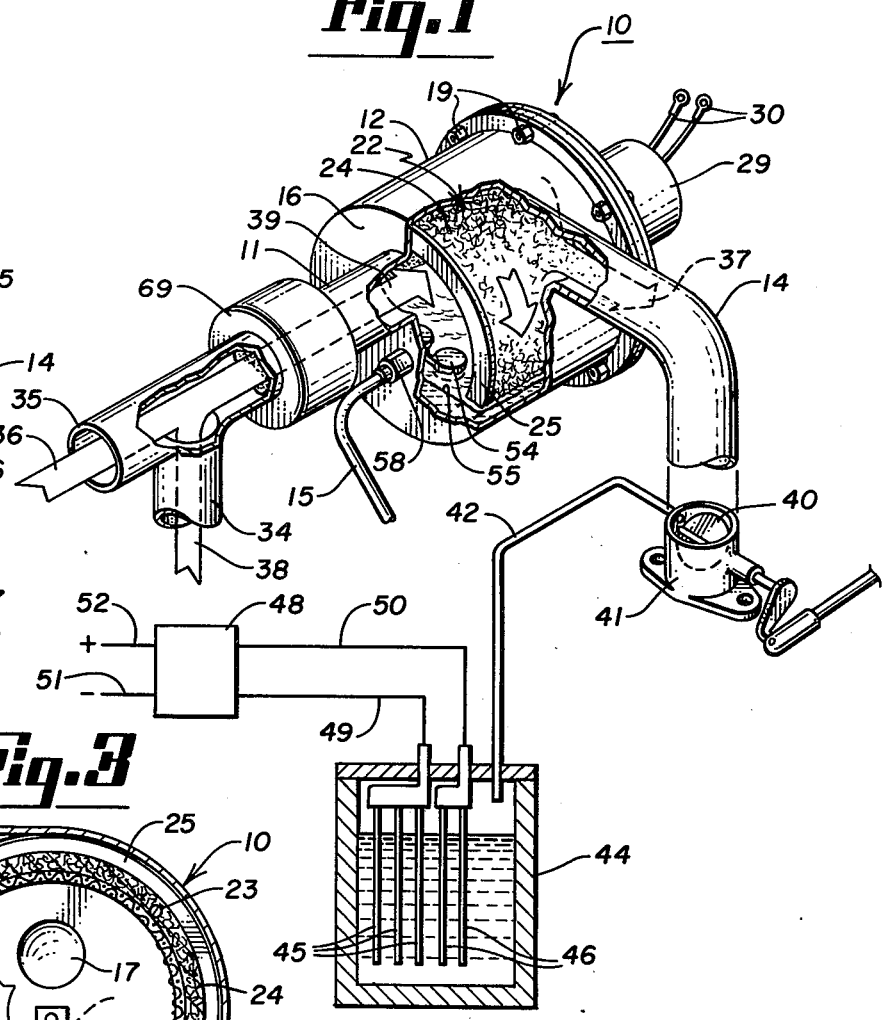
FIG. 1 is a pictorial view, with sections broken away, of the fuel mixing device of the present invention.
Figure 3:
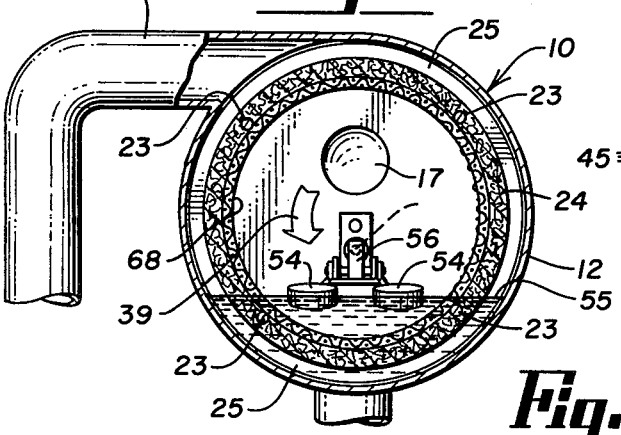
FIG. 3 is a view, partially in section, as viewed along the section line 3—3 of FIG. 2.
Figure 2:
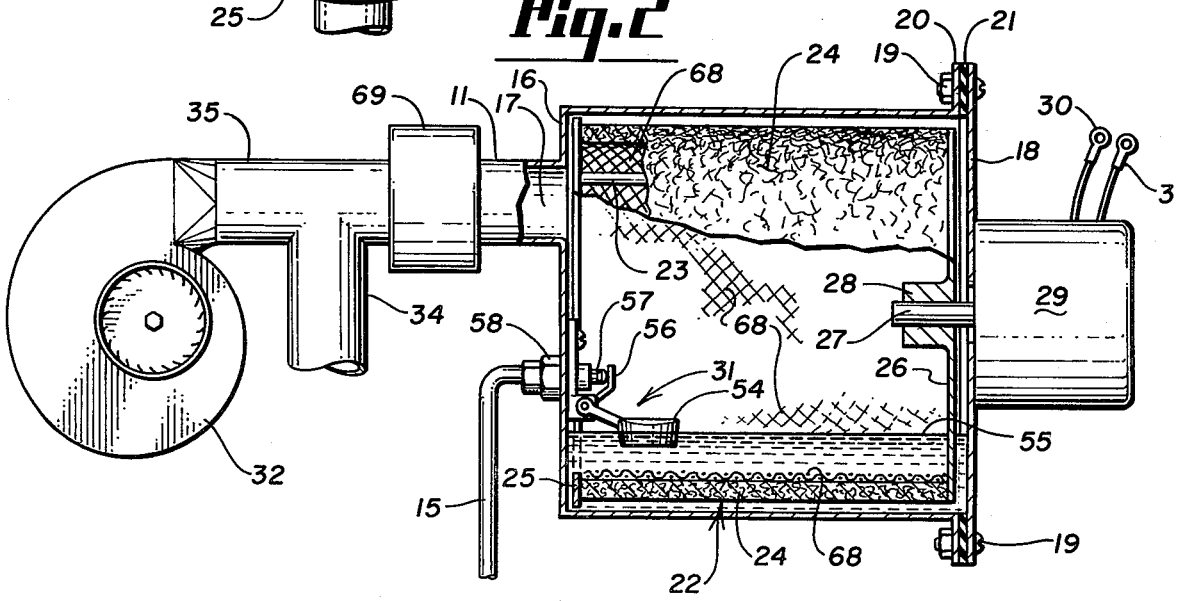
FIG. 2 is a view, partially in section, showing the interior of the atomization chamber of the fuel mixing device of the present invention.

With general reference to FIGS. 1, 2 and 3, the fuel mixing device of the present invention is illustrated generally by the reference numeral 10. This device includes an atomizing chamber 12, a means 11 for supplying atomizing air to the chamber 12, a means 15 for supplying fuel to the atomizing chamber 12 and a conduit 14 for directing the air/fuel mixture from the chamber 12 to the combustion chambers of a conventional internal combustion engine.

The atomizing chamber 12 comprises a generally horizontally disposed cylindrical housing member having a cylindrically shaped side wall and a pair of end walls 16 and 18 disposed generally parallel with respect to each other and at right angles with respect to the side wall. As illustrated best in FIG. 2, the end wall 16 is integrally formed with the side wall whereas the end wall 18 is connected with the side wall and thus the main body of the chamber 12 by a plurality of screw or rivet members 19. To facilitate the connection of the end wall 18 to the chamber 12, the side wall of the chamber 12 includes an outwardly extending flange portion 20 adapted to mate and connect with the end wall 18. A sealing gasket 21 is disposed between the flange 19 and the end wall 18 to provide a seal between these two elements. In the preferred embodiment, the gasket 21 is constructed of a cork base or some other material which is resistent to gasoline.

Disposed within the atomizing chamber 12 is a rotatable atomizing drum 22. The atomizing drum 22 includes a cylindrically shaped side wall 24, a peripheral flange portion 25 extending radially outwardly from an open end of the side wall 24, an end wall 26 connected with a portion of the side wall 24 and extending inwardly to a centrally disposed hub 28 and a plurality of support rods 23 extending between the flange 25 and the end wall 26 to support the side wall 24.

As illustrated best in FIG. 2, the hub 28 is connected with an output shaft 27 of an electric motor 29. The shaft 27 extends from the motor 29 and through the end wall 18 to connect with the hub 28. The elecric motor is a conventional electric motor powered by a 12 volt automobile battery (not shown). This is provided to the motor 29 by appropriate connection with the electrical leads 30, 30. Actuation of the motor 29 causes rotation of the shaft 27 and the hub 28, and thus corresponding rotation of the inner atomizing drum 22 in the direction of the arrow 39. In the preferred embodiment, the motor 29 drives the drum 22 at the rate of about thirty revolutions per minute.

The fuel mixing device 10 of FIG. 1 also includes means for providing a supply of gasoline to the atomization chamber 12. This means includes the conduit 15 and the valve assembly 31 (FIG. 2). The valve assembly 31 includes a conventional float/needle valve arrangement in which the float elements 54 (FIGS. 1, 2 and 3) of a float valve float on the level of gasoline 55 maintained within the chamber 12. The float valve includes a tab portion 56 which engages a needle valve 57 to control the supply of gasoline to the chamber 12. As the level of gasoline 55 falls, the floats 54 also fall, thus causing disengagement between the tab 56 and the needle valve 57 and resulting flow of gasoline or other fuel into the chamber 12. As the level of gasoline 55 rises, the floats 54 also rise, thus causing engagement between the tab 56 and the needle valve 57. This engagement stops the flow of gasoline into the chamber 12. The needle valve 57 and the supply conduit 15 are connected by an appropriate connection 58. The level of gasoline 55 maintained in the chamber 12 should be sufficient to cover a portion of the side wall 24 of the atomizing drum 22. In the preferred embodiment, gasoline having a depth of about one and one-half inches is maintained in the nine inch diameter chamber 12. As illustrated in FIG. 2, the level 55 covers a full length of a portion of the side wall 24.

The side wall 24 is constructed of a filter or mesh type of material which enables gasoline to become entrained in the side wall as it is rotated through the supply of gasoline or other fuel in the bottom of the chamber 12. Although it is contemplated that a variety of different types of materials could be used for the side wall 24, the preferred embodiment of the present invention contemplates a filter or mesh type of material comprising a synthetic polyethylene fiber matte material supported by a galvanized screen 68 having approximately a one quarter inch mesh. This filter or mesh material in the preferred embodiment is approximately one quarter of an inch thick. Such thickness causes the atomizing air to pass through the side wall 24 in a generally circuitous path to increase the atomization and vaporization of the fuel. Accordingly, the side wall 24 should be sufficiently thick to direct the atomizing air in a circuitous path. The filter or mesh material of the preferred embodiment has openings of approximately 40/1000 of an inch.

Although the preferred embodiment shows the atomizing drum 22 as being a hollow cylindrical structure, it is contemplated that drums of other shapes could also be utilized to obtain the advantages of the present invention. For example, a cone-shaped or frusto cone-shaped drum could be utilized. With a structure of this sort, it would be preferable for the level of gasoline in the chamber 12 to be sufficiently high to cover at least one full length of the side wall or to have the longitudinal axis of the conical drum tilted to achieve the same result.

As shown best in FIGS. 2 and 3, the flange portion 25 of the atomizing drum 22 extends radially outwardly from the open end of the side wall 24. The function of this flange 25 is to support the side wall 24 and to also prevent air from leaking between the flange 25 and the inner surface of the chamber 12. To accomplish this latter function, it is preferable for the outer peripheral edge of the flange 25 to be closely aligned with the interior cylindrical surface of the chamber 12. Such a structure forces the atomizing air to flow outwardly through the mesh or filter type material of the side wall 24 as indicated in FIG. 1 by the directional arrow 37.

The end wall 16 of the atomizing chamber 12 includes an opening 17 for communication with a conduit means 11 for providing a source of atomizing air to the interior of the drum 22. The means 11 includes a conduit or tubular section extending from a conventional squirrel cage fan 32 (FIG. 2) or other similar air supplying means and a conduit 34 for providing air from a second source. In the preferred embodiment, it is contemplated that the air provided through the conduit 34 would be warm or hot air taken from the manifold of the operating internal combustion engine. It has been found that this warmed air used as atomizing air in combination with the specific atomizing means of the present invention significantly improves the atomization of the fuel. As shown in FIG. 1, the air provided from the conventional fan means such as the squirrel cage fan 32 (FIG. 2) is indicated by the directional arrow 36 while the air provided from the engine manifold is indicated by the directional arrow 38. The two sources of air are combined together and pass through a filter 69 within the conduit means 11, thereby resulting in a flow through the opening 17 indicated by the directional arrow 39. This atomizing air is directed through the open end of the atomizing drum 22 and into the interior of such drum where it is forced through the meshed side wall 24. As the air passes through the side wall 24, it atomizes and causes the evaporation of gasoline entrained in the side wall 24. It has been found that this structure results in a very complete and thorough atomization and vaporization of the gasoline and thus results in greater fuel efficiency. This air/fuel mixture is then directed by the conduit 14 to the throttle valve 40 (FIG. 1) of an internal combustion engine. In the preferred embodiment, the throttle valve 40 comprises a conventional butterfly valve which controls the flow of the air/fuel mixture to the combustion chambers. The bottom end of the conduit 14 is connected with a baseplate 41 for further connection to the manifold leading to the combustion chambers. It should be noted that the upper end of the conduit 14 extends tangentially and horizontally outwardly from the top of the chamber 12 through an opening in the chamber 12. This relationship between the conduit 14 and the chamber 12 is best illustrated in FIGS. 1 and 3. It should also be noted that rotation of the drum 22 is in the direction of the arrow 39 to assist the air flow through the side wall 24 and into the conduit 14.

As shown in FIG. 1, immediately upstream from the throttle valve 40 and disposed within the tube 14 is a conduit 42 for supplying a small amount of hydrogen to the air/fuel mixture. This conduit 42 is connected with and extends from a container 44 which contains means for providing a supply of hydrogen. In the preferred embodiment, the container contains a soda bath comprising water and sodium carbonate (baking soda) and a plurality of metal plate electrodes 45, 45, 45 and 46, 46. The plates 45, 45, 45 are connected to the positive pole 49 of a five volt source 48 while the plates 46, 46 are connected with the negative pole 50 of the five volt source 48. The five volt source 48, in the preferred embodiment, comprises a conventional five volt regulator which is connected with the leads 51 and 52 of a conventional car battery. When current is provided to the five volt regulator 48 and thus into the solution within the container 44, hydrogen gas is produced by electrolysis. This hydrogen gas is directed by the conduit 42 to the conduit 14 where it is mixed with the air/fuel mixture. It has been found that supplementing the air/fuel mixture with a small amount of hydrogen in the manner illustrated in FIGS. 1 and 2 results, both by itself, but also in combination with the improved atomizing means described above, in a significant increase in fuel efficiency. This in turn leads to a dramatic increase in the miles per gallon obtainable by an automobile utilizing the features of the present invention.

Although it is contemplated that other means could be used as a source of hydrogen, electrolysis of the caustic soda bath or some other solution which will produce hydrogen is preferred. In the preferred embodiment, the container 44 is approximately a one-half gallon container. Initially, water is added to this container 44 with a couple teaspoons of household baking soda. It has been found that this produces a sufficient supply of hydrogen which, in the preferred embodiment, is less than about 10% of the air/fuel mixture and preferably about 5%. The solution in the container 44 is supplemented, when needed, by additional baking soda and/or water.

Figure 4:
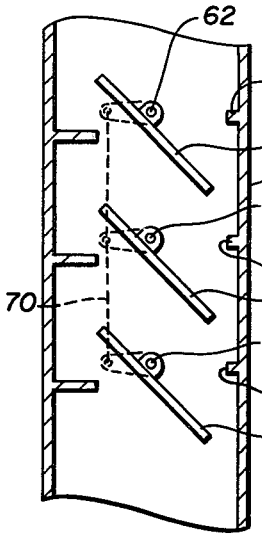
FIG. 4 is a cross-sectional view of a portion of the conduit for directing the air/fuel mixture to the combustion chambers of the engine.

As illustrated in FIG. 4, check valve means are also provided to prevent an engine back fire from entering the atomization chamber 12. This means includes the three baffle plates 59, 60 and 61 which are pivotally supported by the pivot pins 62, 63 and 64 extending horizontally across a vertical portion of the conduit 14. Corresponding stop tabs 65, 66 and 67 are associated with the baffle plates 59, 60 and 61 to limit the rotation of the plates relative to the pins 62, 63 and 64. The pins 62, 63 and 64 are offset from the centers of their respective plates 59, 60 and 61 to allow the plates to hang at an angle as shown in FIG. 4. As can be seen the baffle plates 59, 60 and 61 will allow flow of air downwardly as shown in FIG. 4, but will prevent flow in the opposite direction caused by a blast or back fire. The plates 59, 60 and 61 are joined together by the rod 69 which causes them to pivot together.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

I claim:

1. A fuel mixing device for producing an air/fuel mixture for use in the combustion chambers of an internal combustion engine comprising:
   - a fuel atomization chamber;
   - a rotatable atomization drum disposed within said fuel atomization chamber and adapted for rotation about its axial axis, said atomization drum having a side wall comprised of a porous, mesh-like material and forming a closed side wall loop around said axial axis;
   - means for rotating said atomization drum;
   - means for maintaining a level of fuel within said fuel atomization chamber sufficient to contact at least a portion of the side wall of said rotatable atomization drum; and
   - means for directing a supply of atomizing air to the interior of said closed side wall loop and through said side wall to produce said air/fuel mixture.

2. A fuel mixing device for producing an air/fuel mixture for use in the combustion chambers of an internal combustion engine comprising:
   - a fuel atomization chamber;
   - a rotatable atomization drum disposed within said fuel atomization chamber and adapted for rotation about its axial axis, said atomization drum having a side wall comprised of a porous, mesh-like material;
   - means for rotating said atomization drum;
   - means for maintaining a level of fuel within said fuel atomization chamber sufficient to contact at least a portion of the side wall of said rotatable atomization drum;
   - means for directing a supply of atomizing air to the interior of said rotatable atomizing drum and through said side wall to produce said air/fuel mixture; and
   - a conduit means connected with said fuel atomization chamber for directing said air/fuel mixture from said chamber to a throttle valve.

3. The fuel mixing device of claim 2 including hydrogen supply means connected with said conduit means for supplementing said air/fuel mixture with hydrogen.

4. The fuel mixing device of claim 3 wherein said air/fuel mixture is supplemented with less than about 10% hydrogen.

5. The fuel mixing device of claim 4 wherein said hydrogen supply means includes electrolysis means for generating said supply of hydrogen.

6. The fuel mixing device of claim 5 wherein said electrolysis means includes a soda bath.

7. The fuel mixing device of claim 2 wherein said conduit means includes a horizontally disposed section tangentially connected with the top of said atomization chamber.

8. The fuel mixing device of claim 7 wherein said conduit means includes a vertically disposed section and wherein said fuel mixing device includes a check valve means preventing the upward flow of air through said vertically disposed section.

9. The fuel mixing device of claim 1 wherein said atomization chamber is generally horizontally disposed.

10. The fuel mixing device of claim 9 wherein said atomization drum is cylindrically shaped and is rotatable about its longitudinal axis.

11. The fuel mixing device of claim 10 wherein the longitudinal axis of said atomization drum is horizontally disposed.

12. The fuel mixing device of claim 1 wherein said side wall is constructed of a porous synthetic fiber material having sufficient thickness to permit passage of said atomizing air through said side wall only along a generally circuitous path.

13. The fuel mixing device of claim 12 wherein said side wall is constructed of a synthetic polyethylene fiber.

14. The fuel mixing device of claim 1 wherein said means for maintaining a level of fuel within said fuel atomization chamber includes a float/valve means.

15. The fuel mixing device of claim 1 wherein said means for directing a supply of atomizing air to the interior of said atomizing drum includes means for directing warm air from said engine manifold to the interior of said atomizing drum.

16. A fuel mixing device for producing an air/fuel mixture for use in the combustion chambers of an internal combustion engine comprising:

a fuel atomization chamber;

an atomization member disposed within said fuel atomization chamber, said atomization member defining an interior chamber and having a side wall portion comprised of a porous, mesh-like material and forming a closed side wall loop;

means for maintaining a level of fuel within said fuel atomization chamber sufficient to contact said side wall portion of said atomization member;

means for causing movement of said side wall portion into, through and out of said level of fuel maintained within said fuel atomization chamber; and means for causing the movement of atomizing air to the interior of said side wall loop and through said side wall portion to produce said air/fuel mixture.

* * * * *